US012410678B2

(12) United States Patent
Reding et al.

(10) Patent No.: US 12,410,678 B2
(45) Date of Patent: Sep. 9, 2025

(54) EXPANDABLE ELEMENT ASSEMBLY WITH EXTERNAL RIGID SUPPORT ELEMENT TO ISOLATE WELL INTERVAL

(71) Applicant: Halliburton Energy Services, Inc., Houston, TX (US)

(72) Inventors: Christian Reding, Houston, TX (US); Marcus Ray Hudson, Pearland, TX (US); Wei Zhang, Humble, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 18/402,959

(22) Filed: Jan. 3, 2024

(65) Prior Publication Data

US 2025/0215764 A1 Jul. 3, 2025

(51) Int. Cl.
*E21B 33/128* (2006.01)
*E21B 33/124* (2006.01)

(52) U.S. Cl.
CPC ..... *E21B 33/128* (2013.01); *E21B 33/1243* (2013.01)

(58) Field of Classification Search
CPC ..... E21B 33/128; E21B 33/1243
See application file for complete search history.

(56) References Cited

U.S. PATENT DOCUMENTS 10,760,373 B2 9/2020 Phan et al.
2004/0194969 A1 10/2004 Hiorth et al.
2014/0290944 A1 10/2014 Kristoffer
2016/0230496 A1* 8/2016 Lastra ..... E21B 33/128
2019/0120011 A1* 4/2019 Kellner ..... E21B 33/1216
2021/0156221 A1 5/2021 Phan et al.
2022/0268116 A1* 8/2022 Brown ..... E21B 33/1208

FOREIGN PATENT DOCUMENTS

WO 2011037581 A1 3/2011

OTHER PUBLICATIONS

PCT/US2024/010115 , "International Search Report and Written Opinion", Sep. 23, 2024, 11 pages.

* cited by examiner

*Primary Examiner* — Nicole Coy
*Assistant Examiner* — Jennifer A Railey
(74) *Attorney, Agent, or Firm* — Kilpatrick Townsend & Stockton LLP

(57) ABSTRACT

An expandable element isolation assembly and a well interval isolation device utilizing at least a pair of expandable element isolation assemblies to isolate a well interval are disclosed. An expandable element isolation assembly can comprise an expandable element, and at least one rigid support element that is located external to the expandable element and is positionable between at least part of the expandable element and an inner wall of a formation at an open-hole portion of a wellbore in response to expansion of the expandable element. The at least one rigid support element can reinforce the expanded expandable element, such as through physical contact therewith. A retraction mechanism may be provided to retract the at least one rigid support element upon contraction of the expandable element.

19 Claims, 6 Drawing Sheets

EXPANDABLE ELEMENT ASSEMBLY WITH EXTERNAL RIGID SUPPORT ELEMENT TO ISOLATE WELL INTERVAL

TECHNICAL FIELD

The present disclosure relates generally to hydrocarbon well operations, and more particularly although not necessarily exclusively, to an expandable element assembly for use in isolating well intervals.

BACKGROUND

During a completion phase of a hydrocarbon well, an open hole well zone (or interval) of interest may be isolated from the remainder of a hydrocarbon well for various reasons. Isolating an open hole well interval of interest is commonly accomplished using a cooperating pair of spaced apart expandable elements, such as the inflatable packers of a straddle packer device. A straddle packer device can be positioned on a tool string that can be used to run the straddle packer to a desired downhole location. After the straddle packer is at the desired downhole location, the expandable elements may be expanded to isolate the well interval located between the expandable elements from fluid and pressure in other portions of the well.

DETAILED DESCRIPTION

Figure 1:
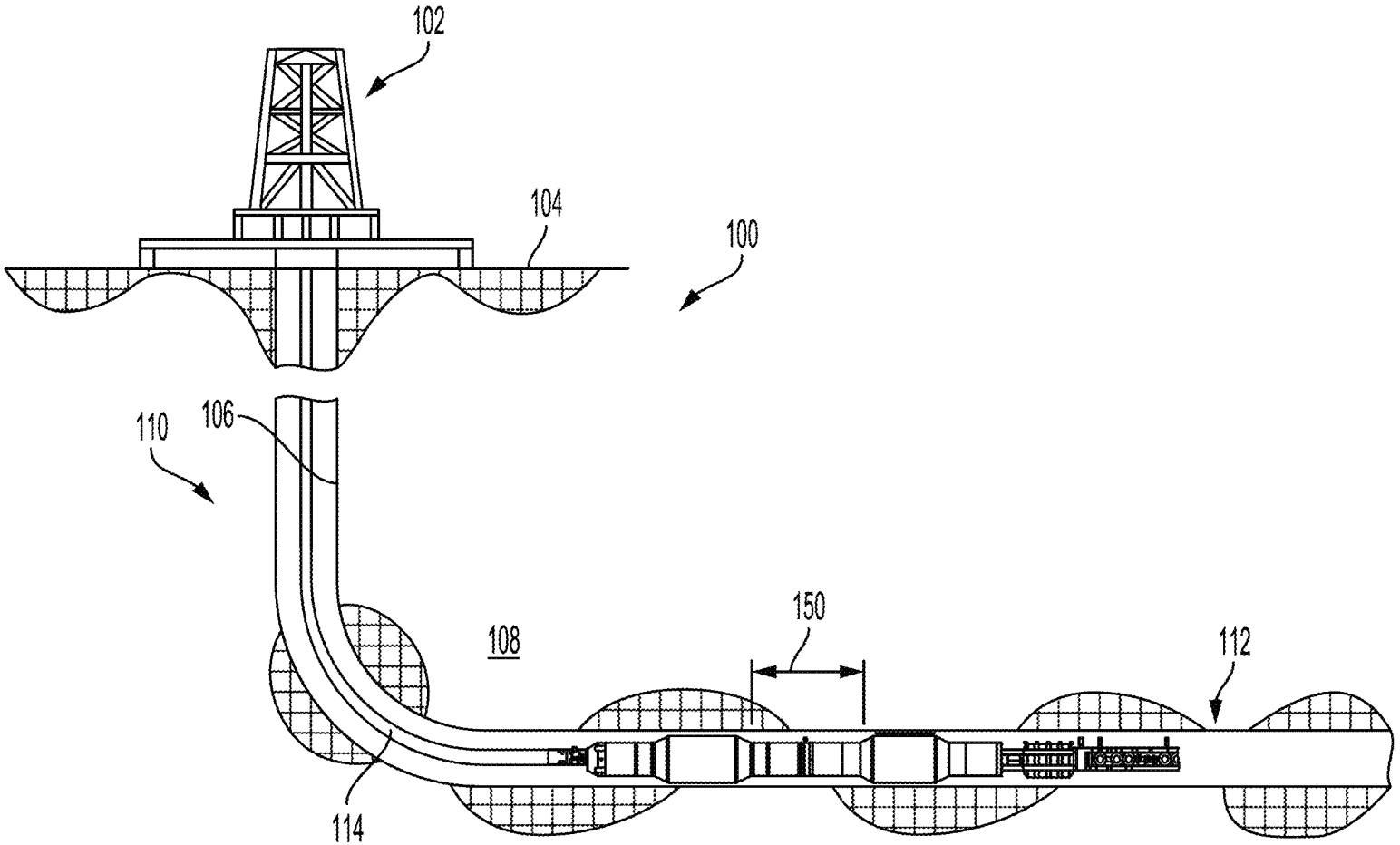
FIG. 1 is a schematic diagram of a well interval isolation device located within an open hole portion of a hydrocarbon wellbore according to one example of the present disclosure.

Certain aspects and examples of the present disclosure relate to an expandable element isolation assembly, and to a rigid support element that can increase a maximum differential pressure rating of the expandable element isolation assembly. By utilizing rigid support elements to limit or prevent undesirable deformation of the expandable isolation elements of an expandable element isolation assembly, the differential pressure between a well interval isolated by the expandable element isolation assembly and the hydrostatic pressure of the surrounding well fluid may be considerably greater than is normally possible through the use of known expandable elements.

An example of an expandable element isolation assembly can include an expandable element and an associated rigid support element. The rigid support element is located external to the expandable element and may be positionable between at least a part of the expandable element and an inner wall of a formation at an open-hole portion of a wellbore in response to expansion of the expandable element. When the rigid support element is so positioned upon expansion of the expandable element, the rigid support element can act as an external reinforcement of the expandable element. The reinforcement can substantially increase the differential pressure range with which the expandable element can be used.

Rigid support elements of various designs may be provided according to examples of an expandable element isolation assembly. For example, an annular array of overlapping rigid support petals may encircle one end of an expandable element according to one example of an expandable element isolation assembly. The rigid support petals may be positioned between at least part of the expandable element and an inner wall of a formation at an open-hole portion of a wellbore in response to expansion of the expandable element. Upon contraction of the expandable element, the rigid support petals may return to a retracted position where the rigid support petals move away from the inner wall of the wellbore and toward a central axis or centerline of the wellbore.

In at least one example of an expandable element isolation assembly, the rigid support petals or another rigid support element may be retracted by a spring acting on a linkage coupled to the rigid support petals/element. In another example, the rigid support petals or another rigid support element may be directly retracted by a linear actuator, or an elastomeric ring or band. The use of other retraction mechanisms is also possible.

An expandable element isolation assembly may be a part of a well interval isolation device that is positionable on a wireline tool string or a tubing string for deploying the well interval isolation device to a target depth/location within a wellbore. A pair of expandable element isolation assemblies may reside in a spaced apart relationship at opposite ends of a tool portion of the well interval isolation device. The distance between the expandable element isolation assemblies effectively defines the length of the well interval that can be isolated by the well interval isolation device. Different types of tools can be used. For example, a well interval isolation device may utilize a tool via which fluid in an isolated well interval can be extracted for analysis or the pressure within the isolated well interval can otherwise be reduced by evacuation. In another example, a well interval isolation device may utilize a tool via which pressurized fluid can be expelled into an area of the formation that is located within the isolated well interval, such as for purposes of creating microfractures in the formation.

In operation, a well interval isolation device can be delivered into a wellbore to a target depth, such as to a target depth that coincides with a well interval of interest. Upon reaching the target depth, the expandable elements of each expandable element isolation assembly can be expanded, such as through inflation by pressurized fluid. Expansion of the expandable elements can create a seal with the rock or other formation material forming the wellbore wall and can thereby isolate the well interval located between the expandable elements from the fluid in the remainder of the wellbore. The rigid support element respectively associated with each of the expandable elements can be automatically extended via expansion of the expandable elements, as described above. The reinforcement provided by the rigid support elements can help the expandable elements resist deformation and maintain a seal with the wall of the wellbore at higher pressure differentials than would otherwise be possible using expandable elements of known design.

Illustrative examples follow and are given to introduce the reader to the general subject matter discussed herein rather than to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

One example of a well interval isolation device 200 being used to isolate an interval 150 of an open hole portion of a hydrocarbon well 100 is represented in the diagram of FIG. 1. As shown, the hydrocarbon well 100 can include a rig 102 located at a well surface 104. The rig can be used to convey the well interval isolation device 200 relative to a wellbore 106. The wellbore 106 in FIG. 1 is drilled into a subterranean formation 108. In other examples, a wellbore can be drilled through a sub-sea formation. The wellbore 106 is shown to include a vertical portion 110, as well as a horizontal portion 112 that may be absent in other examples. In some examples, the wellbore 106 may also include a deviated portion. The well may be a hydraulic fracturing well. While the entirety of the wellbore 106 is depicted in FIG. 1 as an open-hole wellbore for purposes of illustration, it should be understood that in other examples, at least a portion of the wellbore 106 may have a casing installed therein.

In the example shown, the well interval isolation device 200 is part of a tool string attached to tubing 114, which may be coiled tubing. In another example, the well interval isolation device 200 may instead be part of a tool string that is conveyed by a wireline. While the rig 102 of the hydrocarbon well 100 is used to convey the well interval isolation device 200 according to the example of FIG. 1, in other examples, the rig 102 may be replaced with a wellhead (e.g., Christmas tree) or another well completion apparatus, and a wireline rigup may be present to convey the well interval isolation device 200 relative to the wellbore 106.

During a wellbore drilling operation, drilling fluid ("mud") can be pumped downhole to cool a drill bit. During the wellbore drilling operation, the wellbore 106 may also partially fill with various fluids that seep into the wellbore 106 from the formation 108. Samples of the fluids present in the wellbore 106 may be extracted for analysis, such as to determine the nature and desirability (e.g., quality) of the fluids present in various portions of the formation 108. Zonal isolation—i.e., isolation of a particular well interval—may be used in this regard to help ensure that a fluid sample of interest can be extracted without also extracting nearby fluids, or an excessive volume of nearby fluids.

When the well is a hydraulic fracturing well, the formation is typically fractured in various locations using high pressure fluid. To optimize fracture placement and for other reasons, well operators may utilize microfracturing techniques to measure stresses within different portions of the formation. Microfracturing techniques commonly utilize one or more jets of highly pressurized fluid to create small fractures in the formation 108. As is the case with fluid sampling/extraction, a microfracturing operation may be performed within an isolated well interval.

Figure 2:
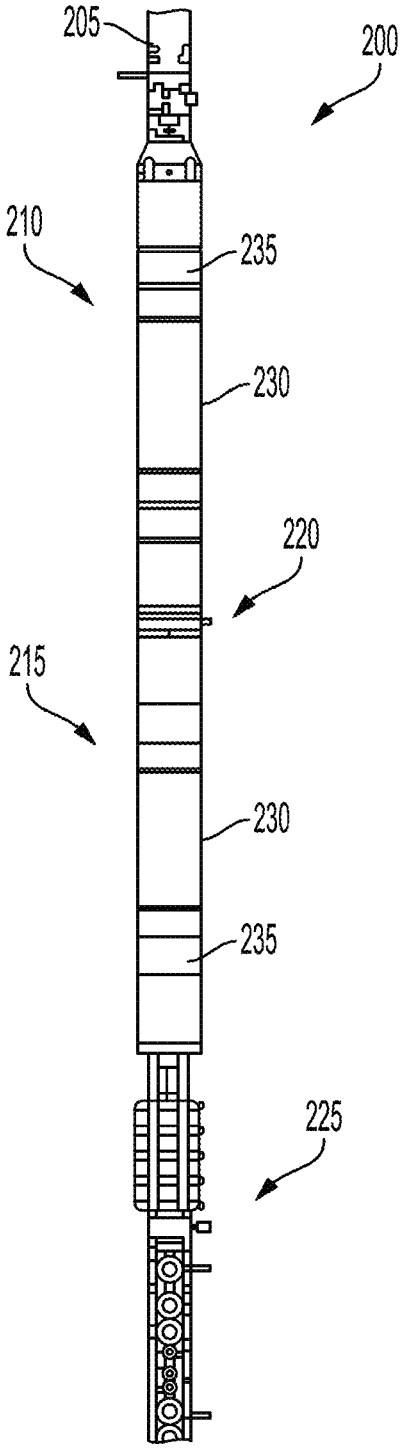
FIG. 2 is a schematic representation of a well interval isolation device with expandable elements thereof in a contracted state according to one example of the present disclosure.
Figure 3:
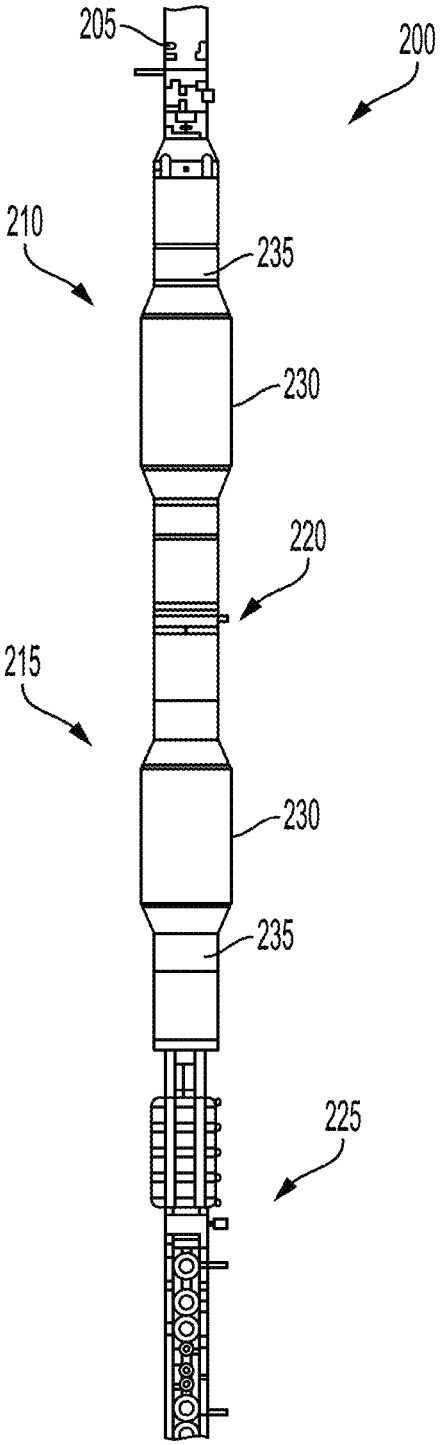
FIG. 3 is a schematic representation of a well interval isolation device with expandable elements thereof in an expanded state according to one example of the present disclosure.

FIGS. 2-3 each depict the well interval isolation device 200 example shown in FIG. 1. As shown, the well interval isolation device 200 can include at least one pair of expandable element isolation assemblies comprising an uphole expandable element isolation assembly 210 and a downhole expandable element isolation assembly 215. A tool 220, such as a fluid extraction tool or a microfracturing tool, can reside between the uphole expandable element isolation assembly 210 and the downhole expandable element isolation assembly 215. Various valves 225 and/or other components of the well interval isolation device 200 may be located between a downhole end of the downhole expandable element isolation assembly 215 and a remainder of the tool string 205, as shown.

Each of the uphole expandable element isolation assembly 210 and the downhole expandable element isolation assembly 215 is shown to include an expandable element 230 and an associated rigid support element 235. The uphole expandable element isolation assembly 210 and the downhole expandable element isolation assembly 215 are arranged in a mirrored relationship on the tool string 205 in this example.

In FIG. 2, the expandable elements 230 of each of the uphole expandable element isolation assembly 210 and the downhole expandable element isolation assembly 215 are shown in a contracted state. In FIG. 3, each of the expandable elements 230 of the uphole expandable element isolation assembly 210 and the downhole expandable element isolation assembly 215 are expanded, as they would be when the well interval isolation device 200 is used to isolate an interval of an open-hole wellbore. The expandable elements 230 can be expanded in a variety of ways. For example, when the expandable elements 230 are inflatable expandable elements, such as inflatable packers, the expandable elements 230 may be inflated using pressurized fluid. In another example, the expandable elements 230 may instead be comprised of a deformable material such as an elastomeric material. When comprised of a deformable material, the expandable elements 230 may be dynamically expanded by, for example, compression caused by linear translation of one or more of the tool string 205 components.

In an example where the expandable elements 230 are inflatable packers or similar inflatable elements, pressurized fluid may be supplied to the expandable elements 230 from a source of pressurized fluid. The source of pressurized fluid can be located at the well surface. The pressurized fluid may be transmitted to the expandable elements 230 using a pump or a similar apparatus. One or more pressurized fluid conduits may run along an open interior of the tool string 205 to connect one or more sources of pressurized fluid located at the well surface with each of the expandable elements 230. The one or more sources of pressurized fluid maybe connected to the expandable elements 230 in various configurations, such that the expandable elements 230 may be inflated individually or simultaneously. According to one example, the expandable elements 230 can be individually inflated, either through a unique connection between each expandable element 230 and the one or more sources of pressurized fluid, or by utilizing one or more valves to selectively distribute the pressurized fluid to the individual expandable elements 230. In another example, the expandable elements 230 may be connected to the one or more sources of pressurized fluid in a manner such that the expandable elements 230 can only be simultaneously inflated.

Referring again to FIG. 1, it may be observed that the expandable elements 230 of the well interval isolation device 200 are expanded (e.g., inflated) such that an exterior surface thereof is in sealing contact with the rock or other formation material forming the wall of the wellbore 106. The expandable elements 230 can thereby isolate the interval 150 of the wellbore 106 residing between the expandable elements 230 from pressure and other fluid in the wellbore 106. With the well interval isolation device 200 isolating the well interval 150, the tool 220 of the well interval isolation device 200 can be used to perform a desired operation within the isolated well interval 150. As described above, the operation may be a fluid extraction (drawdown) operation or an overpressure (e.g., microfracturing) operation in some examples. Once the desired operation within the well interval 150 is complete, the expandable elements 230 can be contracted (e.g., deflated) and the well interval isolation device 200 may be moved to another wellbore location of interest. The expandable elements 230 can then be reinflated to isolate another well interval.

Figure 4:
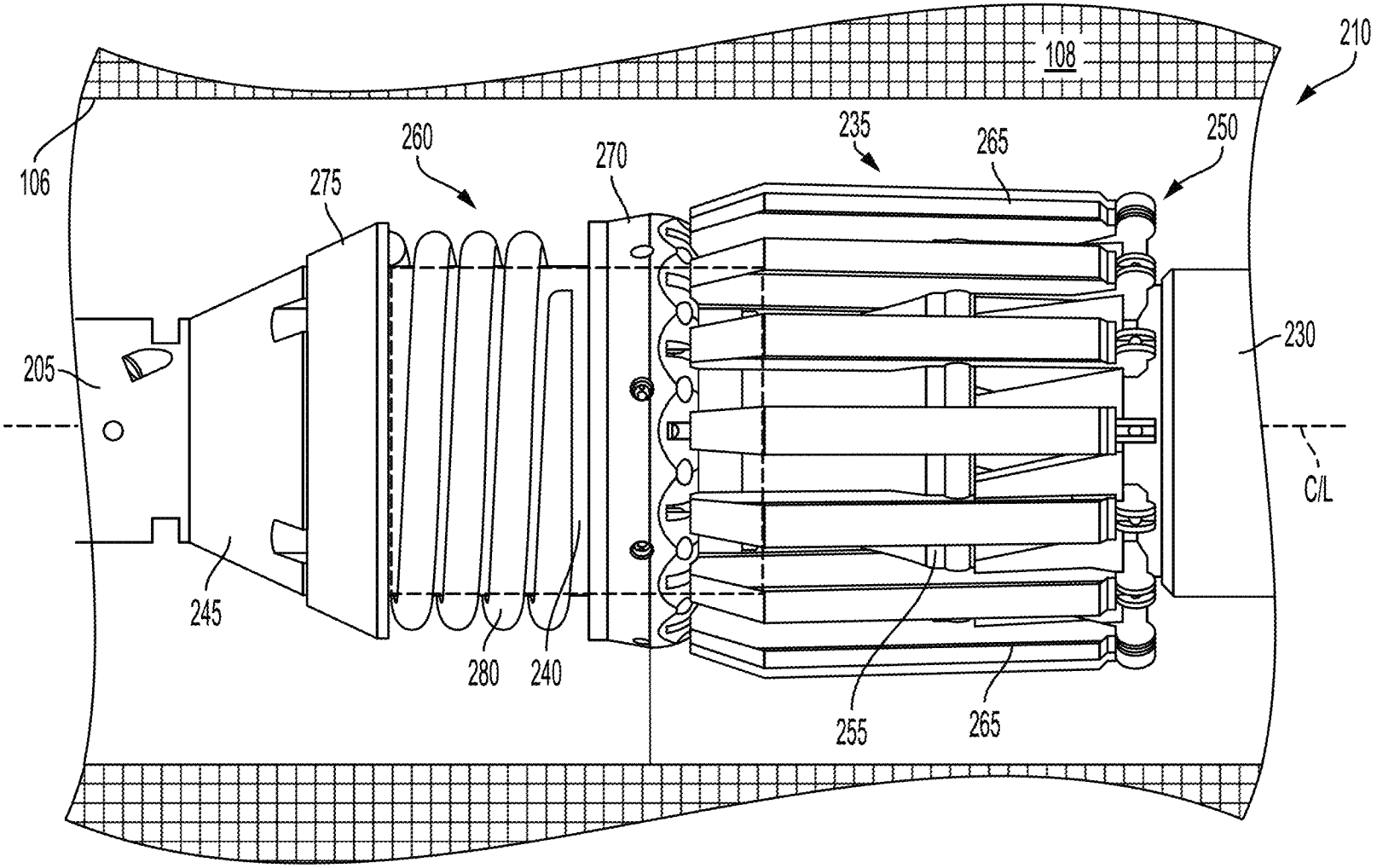
FIG. 4 is an enlarged view depicting a rigid support element of a well interval isolation assembly in a closed position according to one example of the present disclosure.
Figure 5:
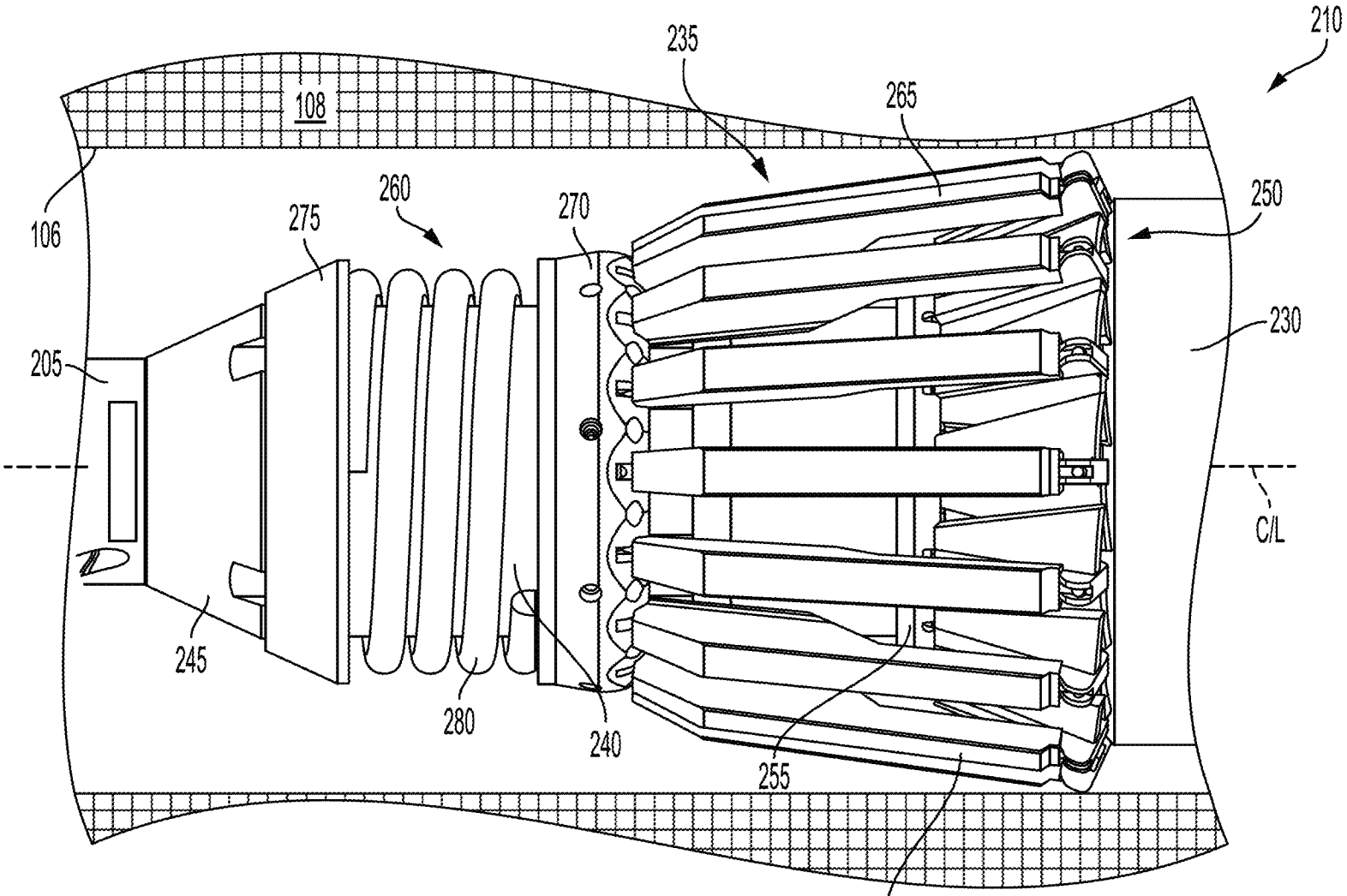
FIG. 5 shows the rigid support element of FIG. 4 in an open position according to one example of the present disclosure.
Figure 6:
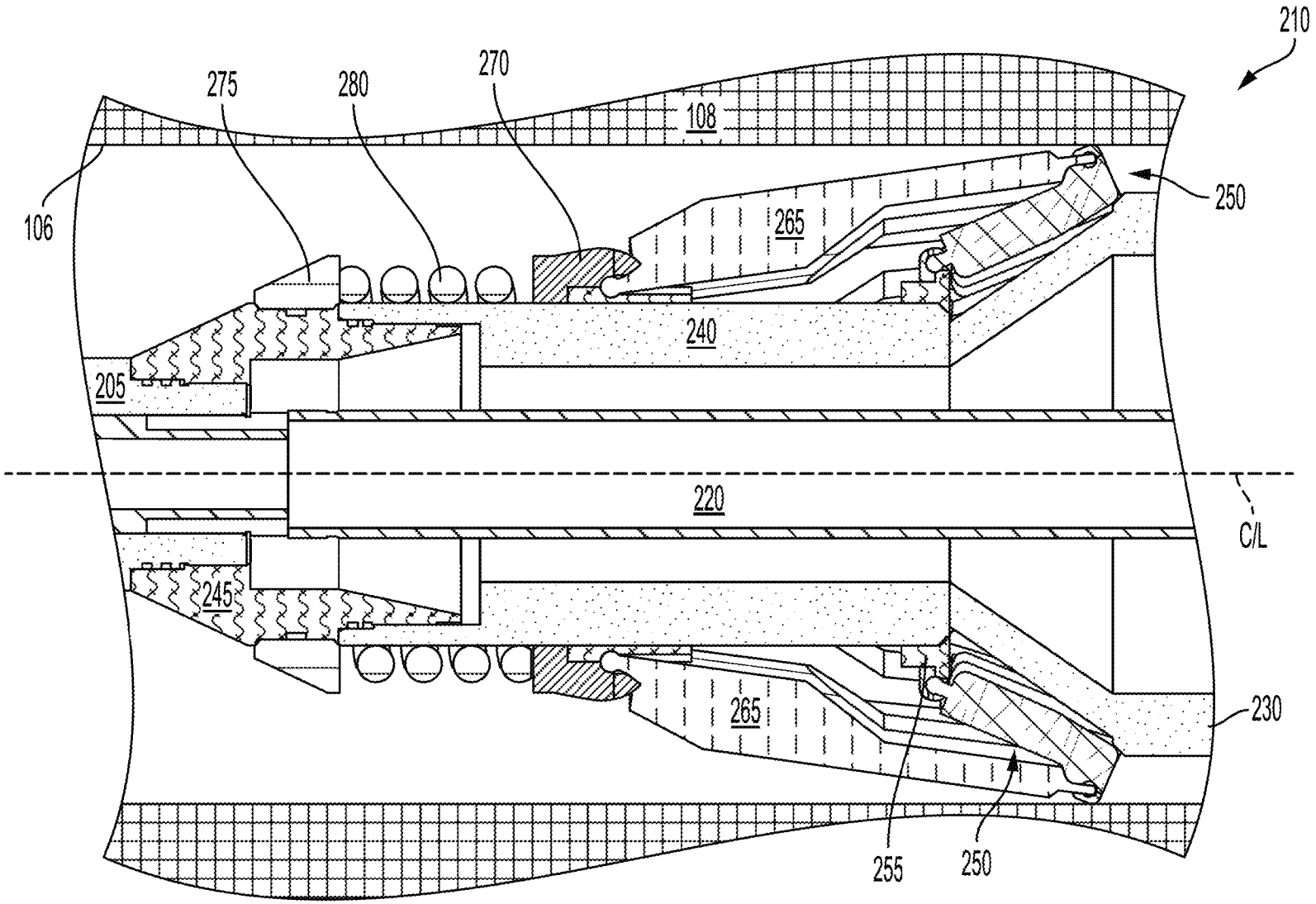
FIG. 6 is a cross-section of the rigid support element shown in FIG. 5.

One example of the uphole expandable element isolation assembly 210 of FIGS. 2-3 may be observed in more detail in FIGS. 4-6. As briefly described above, and as shown in FIGS. 4-6, the expandable element isolation assembly 215 according to this example may include the expandable element 230 in combination with the rigid support element 235. While only the uphole expandable element isolation assembly 210 is described in more detail below for purposes of simplicity, it should be understood that the design, construction, and operation of the uphole expandable element isolation assembly 210 and the downhole expandable element isolation assembly 215 may be the same.

FIG. 4 depicts the uphole expandable element 230 of the uphole expandable element isolation assembly 210 as an inflatable packer in a deflated state. FIGS. 5-6 depict the expandable element 230 of the uphole expandable element isolation assembly 210 as an inflatable packer in an inflated state. It may be observed from FIGS. 4-6 that the rigid support element 235 is located externally of the expandable element 230 of the uphole expandable element isolation assembly 210. The same component arrangement would exist for the expandable element 230 of the downhole expandable element isolation assembly 210.

Expansion of the expandable elements 230 can create a seal with the rock or other formation material forming the wellbore wall and can thereby isolate the well interval located between the expandable elements from the fluid in the remainder of the wellbore, as is generally illustrated in FIG. 1. As may be best understood by reference to FIGS. 5-6, the rigid support element 235 is positionable between at least part of the expandable element 230 and the wall of the formation 108 that forms the open-hole portion of the wellbore 106 in response to expansion of the expandable element 230. That is, outward movement of a portion of the rigid support element 235 toward the wall of the wellbore 106 may be caused by expansion of the expandable element 230.

The expandable element 230 and the rigid support element 235 may be coupled to a body 240 of the expandable element isolation assembly 210. The body 240 of the expandable element isolation assembly 210 may be coupled to a downhole tool, (e.g., tool 220) by an adapter 245. The adapter 245 may also couple the expandable element isolation assembly 210 to the tool string 205 or to another conveyance via which the expandable element isolation assembly 210 can be moved along the length of a wellbore. The body 240 and the adapter 245 are preferably rigid components.

The rigid support element 235 may be of various designs in different examples. In the particular example shown in FIGS. 4-6, the rigid support element 235 includes an assembly comprising an annular array of overlapping and pivotable rigid support petals 250 that encircle the uphole end of the expandable element 230. Each rigid support petal 250 can be pivotably connected at a first end thereof to the body 240 by a fixed position coupling element 255. The rigid support petals 250 may be positioned between at least part of the expandable element and the inner wall of the formation 108 at an open-hole portion of the wellbore 106 in response to expansion of the expandable element 230 (see FIGS. 5-6). Upon contraction/deflation of the expandable element 230, the rigid support petals 250 may return to a retracted position where the rigid support petals 250 are moved away from the inner wall of the wellbore 106 and toward the body 240 of the expandable element isolation assembly 210 and a centerline C/L of the wellbore 106 (see FIG. 4).

According to this example of the expandable element isolation assembly 210, return of the rigid support petals 250 to the retracted position depicted in FIG. 4 can be caused by a retraction mechanism 260 subsequent to or in conjunction with deflation of the expandable element 230. One example of the retraction mechanism 260 may include a plurality of linkage members 265 that are pivotably connected at first ends thereof to second ends of corresponding ones of the rigid support petals 250. An opposite, second end of each linkage member 265 may be pivotably connected to a translating element 270 that is rotationally constrained but free to move linearly within some limited distance along the length of the body 240. The adapter 245 may serve as a fixed-position retainer element, or a separate fixed-position retainer element 275 may be located along the downhole end of the adapter 245 and uphole of the translating element 270, such that a space exists therebetween.

The translating element 270, and the adapter 245 or the retainer element 275, may act to cooperatively retain a compression spring 280 or another resilient element that exerts a biasing force against the translating element 270. The force exerted on the rigid support petals 250 during inflation of the expandable element 230 can be transferred to the linkage members 265 to cause a linear displacement of the translating element 270 toward the adapter 245 by overcoming the biasing force of the compression spring 280. Upon deflation of the expandable element 230, the biasing force of the compression spring 280 can produce an opposite direction linear displacement of the translating element 270 toward the expandable element 230. This opposite direction linear displacement of the translating element 270 can also cause the linkage members 265 to rotate the rigid support petals 250 inward toward the deflated expandable element 230 and the tool 220. The inwardly-directed rotation of the rigid support petals 250 allows the expandable element isolation assembly 210 to maintain a minimal profile, which facilitates movement of the well interval isolation device 200 through the wellbore 106.

It should be understood that the arrangement and orientation of the expandable element isolation assembly 210 in the particular example illustrated by FIGS. 4-6 represents a case where the tool 220 of the well interval isolation device 200 will be used to perform a pressure-increasing operation within an isolated well interval located between the expandable elements 230. One example of such an isolated well interval 150 is shown in FIG. 1. In such a case, increased pressure within the isolated interval can produce a force that is directed away from the tool 220 in both an uphole and a downhole direction. The uphole-directed force will encourage deformation of the uphole expandable element 230 in an uphole direction, while the downhole-directed force will encourage deformation of the downhole expandable element 230 in a downhole direction—i.e., both expandable elements will be biased away from the tool 220.

To counter this encouraged deformation of the expandable elements 230, the uphole expandable element isolation assembly 210 can be arranged on the uphole side of the uphole expandable element 230. While not shown in FIGS. 4-6, the downhole expandable element isolation assembly 215 can likewise be arranged on the downhole side of the downhole expandable element 230. Additionally, and as may be best observed in FIGS. 5-6, the uphole expandable element isolation assembly 210 can be oriented with the rigid support petals 250 thereof adjacent to an uphole end of the uphole expandable element 230. While not shown, the downhole expandable element isolation assembly 215 can be oriented as a mirror image to the uphole expandable element isolation assembly 210, such that the rigid support petals 250 of the downhole expandable element isolation assembly 215 are adjacent to a downhole end of the downhole expandable element 230. As such, expansion of the expandable elements 230 will position the rigid support petals 250 of the associated expandable element isolation assemblies 210, 215 between at least part of the corresponding expandable elements 230 and an inner wall of a formation, and resulting contact of the rigid support petals 250 with the expandable elements 230 can minimize or prevent deformation of the expandable elements 230 away from the tool 220 due to increased pressure in the isolated interval, or otherwise.

In an alternative example, the tool 220 of the well interval isolation device 200 may be used to perform a pressure-decreasing (e.g., drawdown) operation within an isolated well interval located between the expandable elements 230. In such a case, decreased pressure within the isolated interval can produce a force that is directed toward the tool 220 from both an uphole and a downhole direction. These forces will encourage deformation of the uphole expandable element 230 in a downhole direction and deformation of the downhole expandable element 230 in an uphole direction—i.e., both expandable elements will be biased toward the tool 220.

To counter this encouraged deformation of the expandable elements 230, the uphole expandable element isolation assembly 210 can be arranged on the downhole side of the uphole expandable element 230. The downhole expandable element isolation assembly 215 can likewise be arranged on the uphole side of the downhole expandable element 230. Additionally, the uphole expandable element isolation assembly 210 can be oriented with the rigid support petals 250 thereof adjacent to a downhole end of the uphole expandable element 230. The downhole expandable element isolation assembly 215 can be oriented as a mirror image to the uphole expandable element isolation assembly 210, such that the rigid support petals 250 of the downhole expandable element isolation assembly 215 are adjacent to an uphole end of the downhole expandable element 230. As such, expansion of the expandable elements 230 will position the rigid support petals 250 of the associated expandable element isolation assemblies 210, 215 between at least part of the expandable elements 230 and an inner wall of a formation, and resulting contact of the rigid support petals 250 with the expandable elements 230 can minimize or prevent deformation of the expandable elements 230 toward the tool 220 due to a decreased pressure in the isolated interval, or otherwise.

In operation, the well interval isolation device 200 can be placed at a target location (e.g., target depth) within the wellbore 106. In the example of FIG. 1, the target location is an open-hole portion of the wellbore 106. After being positioned in the wellbore 106, the expandable elements 230 of the expandable element isolation assemblies 210, 215 can be expanded until an outside surface of the expandable elements makes sealing contact with the wall of the wellbore 106 (i.e., with the formation 108 in the case of an open hole portion of the wellbore 106). Inflation of the expandable elements 230 causes the rigid support petals 250 of the respective expandable element isolation assemblies 210, 215 to rotate outward and to become positioned between at least part of the expandable elements and the rock or other material of the formation 108 that forms the inner wall of the wellbore 106. The rigid support petals 250, via their location relative to the expandable elements 230 and their connection to the rigid bodies 240 of the respective expandable element isolation assemblies 210, 215, can minimize extrusion gaps between the expandable elements 230 and the formation 108 and reinforce and support the expandable elements 230 through physical contact therewith. The pressure differential rating of the expandable elements 230 may thus be increased by the use of the rigid support petals 250 or other rigid support elements. The increased pressure differential rating can allow a well interval isolated by the well interval isolation device 200 to be subjected to a greater (negative) drawdown pressure or (positive) overpressure than would otherwise be possible when using non-reinforced expandable elements.

As may be observed in FIGS. 5-6, portions/surfaces of the rigid support petals 250 of the uphole expandable element isolation assembly 210 can be placed into contact with the rock or other material of the formation 108 that forms the wall of the wellbore 106 by expansion of the expandable element 230. The wall of the wellbore 106 also acts as a hard stop to further rotation of the rigid support petals 250, and enhances the support and resistance to deformation imparted to the uphole expandable element 230 by the uphole expandable element isolation assembly 210 and the rigid support petals 250 thereof. A like interaction between the rigid support petals 250 of the downhole expandable element isolation assembly 215 and the wall of the wellbore 106 similarly enhances the support and resistance to deformation imparted to the downhole expandable element 230 by the downhole expandable element isolation assembly 215 and the rigid support petals 250 thereof.

According to some examples, an expandable element isolation assembly, such as a packer assembly, can have a design and construction that differs from the design and construction of the expandable element isolation assembly 210 shown in FIGS. 4-6. For example, in one alternative example, the inflatable expandable element 230 can be replaced with an expandable (e.g., elastic) element of substantially solid elastomeric or similar construction. In such an example, the substantially solid expandable element may be expanded radially outward through forced deformation, such as by compressing the expandable element by a linear actuator or by translating movement of one or more components of a tool string of which the expandable element isolation assembly is a part.

In another example, at least the compression spring 280, and the translating element 270 of the expandable element isolation assembly 210 of FIGS. 4-6 can be omitted. The linkage members 265 can also be replaced with one or more motive devices such as compression springs, leaf springs, or linear actuators that are directly pivotably coupled between the body 240 and the second ends of the rigid support petals 250 to produce the inwardly-directed retraction thereof. In another example, at least the compression spring 280, the translating element 270, and the linkage members 265 of the expandable element isolation assembly 210 of FIGS. 4-6 may be replaced with powered rotary actuators, torsion springs, or other rotation inducing motive devices that are coupled to the rigid support petals 250. Such rotation-inducing motive devices can directly rotate the rigid support petals 250 in an inward direction about the first ends thereof upon contraction/deflation of the expandable element 230. In still another example, at least the compression spring 280, the translating element 270, and the linkage members 265 of the expandable element isolation assembly 210 of FIGS. 4-6 may be replaced with an annular spring, or with an elastomeric band or ring, such as an O-ring, which encircles and is in contact with the rigid support petals 250. In such an example, the contracting force of the elastomeric band/ring or annular spring can be overcome by the expansion force of the expandable element 230, but the elastomeric band/ring or annular spring can have sufficient contraction strength to rotate the rigid support petals 250 in an inward direction about the first ends thereof upon contraction (e.g., deflation) of the expandable element 230.

Figure 7:
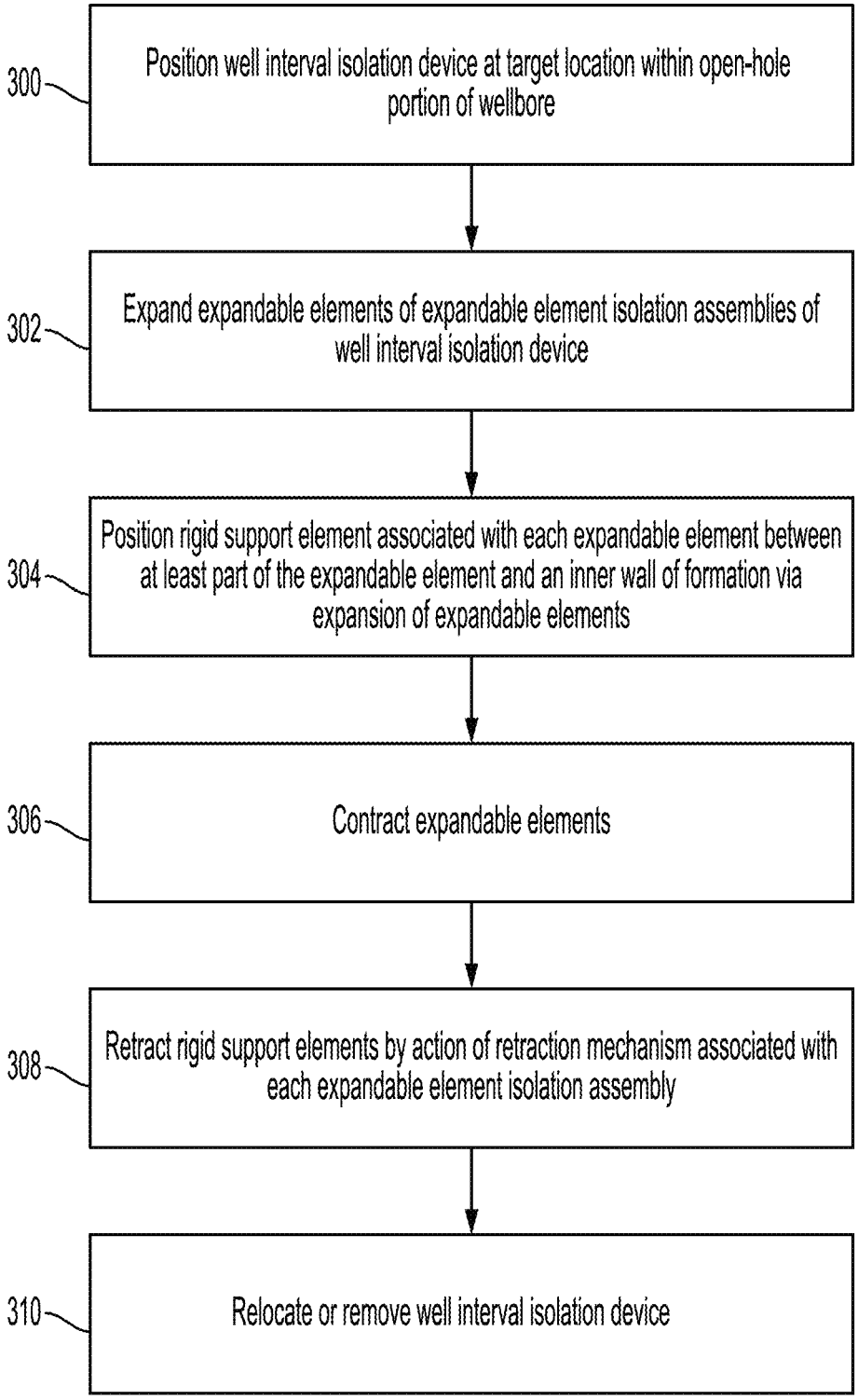
FIG. 7 is a flow chart representing a method for isolating an open hole interval of a hydrocarbon well according to one example of the present disclosure.

FIG. 7 is a flowchart representing a process for isolating an interval of an open-hole portion of a wellbore using a well interval isolation device 200 having expandable element isolation assemblies. As represented in FIG. 6, at block 300 a well interval isolation device according to an example of the present disclosure can be positioned at a target location within an open-hole portion of a wellbore. As described above, the well interval isolation device may comprise a downhole tool in conjunction with an uphole expandable element isolation assembly and a downhole expandable element isolation assembly that are coupled to the downhole tool near opposite ends thereof. According to one example, each expandable element isolation assembly may comprise an expandable element and at least one rigid support element located external to the expandable element. The at least one rigid support element may be positionable between at least part of the expandable element and an inner wall of a formation at an open-hole portion of the wellbore in response to expansion of the expandable element. Each expandable element isolation assembly may also include a retraction mechanism for retracting the at least one rigid support element upon contraction of the expandable element.

At block 302, each of the expandable elements of the expandable element isolation assemblies of the well interval isolation device can be expanded. Expansion of the expandable elements cause an outside surface of each expandable element to create a seal with an inner wall of the formation. In an example, the expandable elements can be inflated using pressurized fluid, such as pressurized fluid supplied by a pump from a fluid source located at the well surface. The pressure within the expandable elements may be monitored during the expandable element inflation process.

In block 304, the at least one rigid support element associated with each expandable element can be positioned between at least part of the expandable element and the inner wall of the formation in response to expansion of the expandable elements. For example, in the case of the expandable element isolation assembly 210 shown in FIGS. 4-6, expansion of an expandable element 230 causes the rigid support petals 250 of the associated rigid support element 235 to be positioned between a portion of the expandable element 230 and an inner wall of the formation 108. With the well interval of interest isolated from surrounding pressure and well fluids by the reinforced expanded expandable elements, the downhole tool can be used to perform an operation within the well interval. The operation may be, without limitation, a drawdown operation that extracts fluid from the interval and reduces the pressure thereof, or an overpressure operation such as a microfracturing operation that increases the pressure within the well interval. Other operations are also possible.

When it is desired to remove the well interval isolation device from the wellbore or to relocate the well interval isolation device within the wellbore, the expandable elements may be contracted, as indicated at block 306. According to the example process represented in FIG. 6, the expandable elements may be contracted by extracting pressurized fluid from within the expandable elements. For example, the aforementioned pump may be used to evacuate fluid from within the expandable elements.

As represented at block 308, with the expandable elements contracted or in the process of contracting, the rigid support elements may be retracted by action of a retraction mechanism associated with each expandable element isolation assembly. For example, in the case of the expandable element isolation assembly 210 shown in FIGS. 4-6, the biasing force of the compression spring 280 causes a linear displacement of the translating element 270 toward the expandable element 230, which causes the linkage members 265 to rotate the rigid support petals 250 inward toward the deflating/deflated expandable element 230 and the tool 220. The well interval isolation device may then be relocated within the wellbore or removed from the wellbore as indicated at block 310. For example, the tool string on which the well interval isolation device is positioned, can be moved in an uphole or downhole direction relative to the wellbore. This allows the well interval isolation device to be repositioned to a new wellbore target location, whereafter the well interval isolation device can again be used to isolate a desired well interval.

According to aspects of the present disclosure, an expandable element isolation assembly, a well interval isolation device, and a method of isolating an interval of an open-hole portion of a wellbore, are provided according to one or more of the following examples. As used below, any reference to a series of examples is to be understood as a reference to each of those examples disjunctively (e.g., "Examples 1-4" is to be understood as "Examples 1, 2, 3, or 4").

Example 1 is an expandable element isolation assembly for use in a wellbore, the expandable element isolation assembly comprising: an expandable element; and at least one rigid support element located external to the expandable element and positionable between at least part of the expandable element and an inner wall of a formation at an open-hole portion of the wellbore in response to expansion of the expandable element.

Example 2 is the expandable element isolation assembly of example 1, wherein the expandable element is an inflatable packer.

Example 3 is the expandable element isolation assembly of example 1, wherein the at least one rigid support element is an assembly comprising an annular array of overlapping and pivotable rigid support petals that encircle one end of the expandable element.

Example 4 is the expandable element isolation assembly of example 3, wherein each rigid support petal is pivotably connected at a first end thereof to a body of a downhole tool to which the expandable element isolation assembly is coupled.

Example 5 is the expandable element isolation assembly of example 4, further comprising a retraction mechanism for returning the rigid support petals to a retracted position upon contraction of the expandable element.

Example 6 is the expandable element isolation assembly of example 5, wherein the retraction mechanism comprises: a plurality of linkage members pivotably connected at first ends thereof to second ends of corresponding ones of the rigid support petals, second ends of the plurality of linkage members pivotably connected to a translating element that is coupled to the body so as to be linearly displaceable relative thereto; and a spring exerting a biasing force against the translating element in a direction of the expandable element; wherein, upon contraction of the expandable element, the biasing force of the spring is directed to cause a linear displacement of the translating element toward the expandable element and a resulting inward rotation of the rigid support petals by the linkage members.

Example 7 is the expandable element isolation assembly of example 5, wherein the retraction mechanism comprises a motive device selected from the group consisting of a compression spring, a leaf spring, and a linear actuator, the motive device directly pivotably coupled between the body and second ends of the rigid support petals.

Example 8 is the expandable element isolation assembly of example 5, wherein the retraction mechanism encircles and is in contact with the rigid support petals and comprises a device selected from the group consisting of an elastomeric band, an elastomeric ring, and an annular spring.

Example 9 is a well interval isolation device comprising: an uphole expandable element isolation assembly and a downhole expandable element isolation assembly coupled to a downhole tool near opposite ends thereof, each expandable element isolation assembly comprising: an expandable element; and at least one rigid support element located external to the expandable element and positionable between at least part of the expandable element and an inner wall of a formation at an open-hole portion of a wellbore in response to expansion of the expandable element.

Example 10 is the well interval isolation device of example 9, wherein each expandable element is an inflatable packer.

Example 11 is the well interval isolation device of example 9, wherein the at least one rigid support element is an assembly comprising an annular array of overlapping and pivotable rigid support petals that encircle one end of each expandable element.

Example 12 is the well interval isolation device of example 11, further comprising a retraction mechanism for returning the rigid support petals to a retracted position upon deflation of the expandable elements.

Example 13 is the well interval isolation device of example 12, wherein the retraction mechanism comprises: a plurality of linkage members pivotably connected at first ends thereof to second ends of corresponding ones of the rigid support petals, second ends of the plurality of linkage members pivotably connected to a translating element that is coupled to a body so as to be linearly displaceable relative thereto; and a spring exerting a biasing force against the translating element in a direction of the expandable element; wherein, upon contraction of the expandable element, the biasing force of the spring is directed to cause a linear displacement of the translating element toward the expandable element and a resulting inward rotation of the rigid support petals by the linkage members.

Example 14 is the well interval isolation device of example 12, wherein the retraction mechanism comprises a motive device selected from the group consisting of a compression spring, a leaf spring, and a linear actuator, the motive device directly pivotably coupled between the body and second ends of the rigid support petals.

Example 15 is the well interval isolation device of example 12, wherein the retraction mechanism encircles and is in contact with the rigid support petals and comprises a device selected from the group consisting of an elastomeric band, an elastomeric ring, and an annular spring.

Example 16 is a method comprising: positioning a well interval isolation device at a target location within an open-hole portion of a wellbore, the well interval isolation device comprising: a downhole tool; and an uphole expandable element isolation assembly and a downhole expandable element isolation assembly coupled to the downhole tool near opposite ends thereof, each expandable element isolation assembly comprising: an expandable element; at least one rigid support element located external to the expandable element and positionable between at least part of the expandable element and an inner wall of a formation at an open-hole portion of the wellbore in response to expansion of the expandable element; and a retraction mechanism for retracting the at least one rigid support element upon contraction of the expandable element; and isolating an interval of the wellbore by expanding the expandable elements such that an outside surface of each expandable element is forced into contact with the inner wall of the formation and the at least one rigid support element associated with each expandable element is positioned between at least part of the expandable element and the inner wall of the formation by expansion of the expandable element.

Example 17 is the method of example 16, wherein the retraction mechanism comprises: a plurality of linkage members pivotably connected at first ends thereof to second ends of corresponding ones of an annular array of overlapping and pivotable rigid support petals, second ends of the plurality of linkage members pivotably connected to a translating element that is coupled to a body so as to be linearly displaceable relative thereto; and a spring exerting a biasing force against the translating element in a direction of the expandable element; wherein, upon contraction of the expandable element, the biasing force of the spring causes a linear displacement of the translating element toward the expandable element, which produces an inward rotation of the rigid support petals by the linkage members.

Example 18 is the method of example 17, wherein the retraction mechanism comprises a motive device selected from the group consisting of a compression spring, a leaf spring, and a linear actuator, the motive device directly pivotably coupled between the body and second ends of the rigid support petals.

Example 19 is the method of example 17, wherein the retraction mechanism encircles and is in contact with the rigid support petals and comprises a device selected from the group consisting of an elastomeric band, an elastomeric ring, and an annular spring.

Example 20 is the method of example 16, wherein the expandable elements are expanded by inflation with a pressurized fluid.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An expandable element isolation assembly for use in a wellbore, the expandable element isolation assembly comprising:

an expandable element;

a rigid support element comprising an assembly of an annular array of overlapping and pivotable rigid support petals, each of which is pivotably connected at a first end thereof to a body of a downhole tool to which the expandable element isolation assembly is coupled, the annular array of overlapping and pivotable rigid support petals encircling one end of the expandable element such that a portion of the annular array of overlapping and pivotable rigid support petals is positionable between the one end of the expandable element and an inner wall of a formation at an open-hole portion of the wellbore in response to expansion of the expandable element; and a retraction mechanism for returning the rigid support petals to a retracted position upon contraction of the expandable element.

2. The expandable element isolation assembly of claim 1, wherein the expandable element is an inflatable packer.

3. The expandable element isolation assembly of claim 1, wherein the retraction mechanism comprises:

a plurality of linkage members pivotably connected at first ends thereof to second ends of corresponding ones of the rigid support petals, second ends of the plurality of linkage members pivotably connected to a translating element that is coupled to the body so as to be linearly displaceable relative thereto; and a spring exerting a biasing force against the translating element in a direction of the expandable element;

wherein, upon contraction of the expandable element, the biasing force of the spring is directed to cause a linear displacement of the translating element toward the expandable element and a resulting inward rotation of the rigid support petals by the linkage members.

4. The expandable element isolation assembly of claim 1, wherein the retraction mechanism comprises a motive device selected from the group consisting of a compression spring, a leaf spring, and a linear actuator, the motive device directly pivotably coupled between the body and second ends of the rigid support petals.

5. The expandable element isolation assembly of claim 1, wherein the retraction mechanism encircles and is in contact with the rigid support petals and comprises a device selected from the group consisting of an elastomeric band, an elastomeric ring, and an annular spring.

6. A well interval isolation device comprising:

an uphole expandable element isolation assembly and a downhole expandable element isolation assembly coupled to a downhole tool near opposite ends thereof, each expandable element isolation assembly comprising:

an expandable element;

a rigid support element comprising an assembly of an annular array of overlapping and pivotable rigid support petals, each of which is pivotably connected at a first end thereof to a body of a downhole tool to which the expandable element isolation assembly is coupled, the annular array of overlapping and pivotable rigid support petals encircling one end of the expandable element such that a portion of the annular array of overlapping and pivotable rigid support petals is positionable between the one end of the expandable element and an inner wall of a formation at an open-hole portion of a wellbore in response to expansion of the expandable element; and a retraction mechanism for returning the rigid support petals to a retracted position upon contraction of the expandable element.

7. The well interval isolation device of claim 6, wherein each expandable element is an inflatable packer.

8. The well interval isolation device of claim 6, wherein the retraction mechanism comprises:

a plurality of linkage members pivotably connected at first ends thereof to second ends of corresponding ones of the rigid support petals, second ends of the plurality of linkage members pivotably connected to a translating element that is coupled to a body so as to be linearly displaceable relative thereto; and a spring exerting a biasing force against the translating element in a direction of the expandable element;

wherein, upon contraction of the expandable element, the biasing force of the spring is directed to cause a linear displacement of the translating element toward the expandable element and a resulting inward rotation of the rigid support petals by the linkage members.

9. The well interval isolation device of claim 6, wherein the retraction mechanism comprises a motive device selected from the group consisting of a compression spring, a leaf spring, and a linear actuator, the motive device directly pivotably coupled between the body and second ends of the rigid support petals.

10. The well interval isolation device of claim 6, wherein the retraction mechanism encircles and is in contact with the rigid support petals and comprises a device selected from the group consisting of an elastomeric band, an elastomeric ring, and an annular spring.

11. The well interval isolation device of claim 6, wherein:

the uphole rigid support element is arranged on an uphole side of the uphole expandable element to resist an uphole-directed deformation of the uphole expandable element; and the downhole rigid support element is arranged on a downhole side of the downhole expandable element to resist a downhole-directed deformation of the downhole expandable element.

12. The well interval isolation device of claim 11, wherein:

the annular array of overlapping and pivotable rigid support petals of the uphole rigid support element are adjacent to and encircle an uphole end of the uphole expandable element; and the annular array of overlapping and pivotable rigid support petals of the downhole rigid support element are adjacent to and encircle a downhole end of the downhole expandable element.

13. The well interval isolation device of claim 6, wherein:

the uphole rigid support element is arranged on a downhole side of the uphole expandable element to resist a downhole-directed deformation of the uphole expandable element; and the downhole rigid support element is arranged on an uphole side of the downhole expandable element to resist an uphole-directed deformation of the downhole expandable element.

14. The well interval isolation device of claim 13, wherein:

the annular array of overlapping and pivotable rigid support petals of the uphole rigid support element are adjacent to and encircle a downhole end of the uphole expandable element; and the annular array of overlapping and pivotable rigid support petals of the downhole rigid support element are adjacent to and encircle an uphole end of the downhole expandable element.

15. A method comprising:

positioning a well interval isolation device at a target location within an open-hole portion of a wellbore, the well interval isolation device comprising:

a downhole tool; and an uphole expandable element isolation assembly and a downhole expandable element isolation assembly coupled to the downhole tool near opposite ends thereof, each expandable element isolation assembly comprising:

an expandable element;

at least one rigid support element encircling at least a part of the expandable element such that a portion of the at least one rigid support element is positionable between the at least a part of the expandable element and an inner wall of a formation at an open-hole portion of the wellbore in response to expansion of the expandable element; and a retraction mechanism for retracting the at least one rigid support element upon contraction of the expandable element; and isolating an interval of the wellbore by expanding the expandable elements such that an outside surface of each expandable element is forced into contact with the inner wall of the formation and the at least one rigid support element associated with each expandable element is positioned between at least part of the expandable element and the inner wall of the formation by expansion of the expandable element.

16. The method of claim 15, wherein the retraction mechanism comprises:

a plurality of linkage members pivotably connected at first ends thereof to second ends of corresponding ones of an annular array of overlapping and pivotable rigid support petals, second ends of the plurality of linkage members pivotably connected to a translating element that is coupled to a body so as to be linearly displaceable relative thereto; and a spring exerting a biasing force against the translating element in a direction of the expandable element;

wherein, upon contraction of the expandable element, the biasing force of the spring causes a linear displacement of the translating element toward the expandable element, which produces an inward rotation of the rigid support petals by the linkage members.

17. The method of claim 16, wherein the retraction mechanism comprises a motive device selected from the group consisting of a compression spring, a leaf spring, and a linear actuator, the motive device directly pivotably coupled between the body and second ends of the rigid support petals.

18. The method of claim 16, wherein the retraction mechanism encircles and is in contact with the rigid support petals and comprises a device selected from the group consisting of an elastomeric band, an elastomeric ring, and an annular spring.

19. The method of claim 15, wherein the expandable elements are expanded by inflation with a pressurized fluid.

* * * * *